US006024253A

United States Patent [19]

Doctor

[11] Patent Number: 6,024,253

[45] Date of Patent: Feb. 15, 2000

[54] CONTAINER INCLUDING BOTTLE FOR HOLDING LIQUID AND TUBE FOR HOLDING A DROPPER

[76] Inventor: Alice Marie Doctor, Three Colonial Terrace, Pompton Plains, N.J. 07444

[21] Appl. No.: 09/280,320

[22] Filed: Mar. 29, 1999

[51] Int. Cl.[7] ..... B67D 5/60

[52] U.S. Cl. ..... 222/130; 222/420; 215/6; 141/22

[58] Field of Search ..... 222/130, 420; 215/6; 141/21–22

[56] References Cited

U.S. PATENT DOCUMENTS 1,326,878 12/1919 Ritterrath .
1,386,501 8/1921 Hite .
1,528,924 3/1925 Huebner .
1,618,724 2/1927 Pearson .
2,175,917 10/1939 Robinson .
2,340,719 2/1944 Walter .
2,772,704 12/1956 McConnell et al. .
3,215,171 11/1965 Mitchell .
3,676,076 7/1972 Grady ..... 215/6
4,373,640 2/1983 Resio .
5,154,702 10/1992 Foyil ..... 222/420
5,464,048 11/1995 Allen .

*Primary Examiner*—Philippe Derakshani
*Attorney, Agent, or Firm*—Raymond J. Lillie

[57] ABSTRACT

A container which comprises a bottle portion and a tube portion. The bottle portion includes a recess adjacent the top opening of the bottle, whereby one can access small amounts of liquid easily with a dropper. The dropper is stored within the tube, which protects the dropper from contamination by microbes and/or viruses, as well as other contaminants.

6 Claims, 1 Drawing Sheet

CONTAINER INCLUDING BOTTLE FOR HOLDING LIQUID AND TUBE FOR HOLDING A DROPPER

The present invention relates to containers such as bottles, which hold liquids, such as liquid medications, and to droppers for dispensing such medications. More particularly, this invention relates to a container including a bottle for holding liquid medication and a tube for holding a dropper.

In general, bottles which hold liquid medications that are taken out of the bottle with a dropper have a length which is greater than the height of the dropper. In such cases, the dropper is unable to remove liquid at the bottom of the bottle, thus resulting in a waste of such liquid.

In addition, after using the dropper to dispense liquid medication, one may wish to clean and/or disinfect the dropper to prevent contaminating the liquid with subsequent use. The clean dropper needs to dry in a secure place. U.S. Pat. No. 1,326,878, issued to Ritterrath, U.S. Pat. No. 1,618,724, issued to Pearson, and U.S. Pat. No. 3,215,171, issued to Mitchell, disclose means for holding a dropper adjacent the side of the bottle. In each of these patents, the dropper is exposed to the air. Although such exposure may dry the dropper between uses, the dropper also may be exposed to contamination by microorganisms and/or viruses in the surrounding environment. Also, such exposure renders the dropper susceptible to contact with insects or other animals, such as house pets, which also may carry contaminating microorganisms and/or viruses, or other contaminants.

It is therefore an object of the present invention to provide a container for a liquid which enables one to withdraw the entire contents therefrom with a dropper, and to store the clean dropper in a secure attachment to the bottle.

In accordance with an aspect of the present invention, there is provided a container which comprises a bottle portion and a tube portion. The bottle portion includes a top opening, a cap covering the top opening, a front panel, a rear panel, a bottom panel, a first side panel, and a second side panel. The first side panel has an indentation to form a recess adjacent the top opening. The tube portion is attached to the second side panel of the bottle portion. The tube portion includes a top opening, a cap covering the top opening, a cylindrical body portion, and a conical bottom portion.

In one embodiment, the tube portion further comprises at least one opening in the conical bottom portion. In another embodiment, the tube portion further comprises at least one opening in the cap covering the top opening of the tube portion. Preferably, the conical bottom portion includes at least one opening, and the cap covering the top opening of the tube portion includes at least one opening.

In another embodiment, the tube portion further comprises a hinge connecting the cap of the cylindrical body portion.

In a further embodiment, the container further comprises a support means extending from the second side panel to the cylindrical body portion of the tube portion. In yet another embodiment, the container further comprises a support means extending from the second side panel to the conical bottom portion of the tube portion. Preferably, the container includes a support means extending from the second side portion of the bottle portion to the cylindrical body portion of the tube portion, and a support means extending from the second side portion of the bottle portion to the cylindrical bottom portion of the tube portion.

In a most preferred embodiment, the conical bottom portion of the tube portion of the container includes an opening at the apex, and the cap which covers the top opening of the tube portion includes a plurality of openings. The opening in the conical bottom portion provides for release of any residual cleaning fluid draining off the outer surface of the dropper, and also provides for air flow into the dropper as the hole in the end of the dropper rests at the conical bottom portion of the tube portion. The at least one opening in the cap of the tube portion will provide for air to enter to dry the outside of the dropper. The tube portion also includes a hinge which connects the cap with the cylindrical body portion. In addition, the tube portion is fused to or made an integral part of the second side portion of the bottle portion. The container also includes a support means which extends from the second side portion of the bottle portion to the cylindrical body portion of the tube portion, and a support means which extends from the second side portion of the bottle portion to the conical bottom portion of the tube portion. These support means provide for strengthening of the attachment of the tube portion to the bottle portion to prevent separation of the tube portion from the bottle portion.

The present invention is applicable particularly to obtaining liquids, such as liquid medications, with a dropper, and more particularly, the present invention enables one to obtain liquid medications from a bottle when there is a small amount of liquid medication remaining in the bottle. When there is a small amount of liquid medication remaining in the bottle portion, the container is tilted such that the liquid medication travels to the recess, adjacent to top opening, that is formed by the indentation in the first side panel. The recess may be accessed by the dropper, which withdraws a desired amount of medication. Thus, the present invention prevents the waste of liquid medication by enabling the entire amount of the liquid medication to be accessible by a dropper.

In addition, the container of the present invention provides an improved means for protecting a dropper from contamination. Previous liquid medication bottles included attachments for holding a dropper to the outside of the bottle. Such attachments, however, left the dropper exposed to the outside and thus susceptible to contamination by microorganisms and viruses or other contaminants, and exposed to possible animal contact, such as contact with insects or pets. By placing the dropper in a tube which is attached to the bottle, the possibility of contamination of the dropper by microorganisms or viruses or other contaminants is decreased greatly and contact of the dropper with insects or pets is prevented. Also, the fact that the tube portion is fused to the bottle portion prevents the stored dropper from being misplaced at a distance from the bottle containing the liquid medication to be dispensed.

The invention now will be described with respect to the drawings, wherein.

Figure 1:
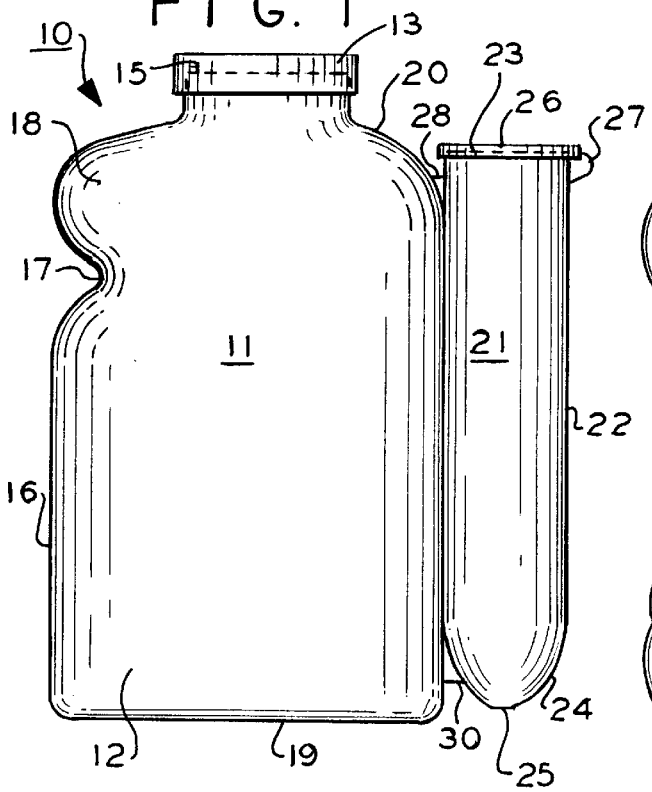
FIG. 1 is a front view of an embodiment of the container of the present invention.
Figure 4:
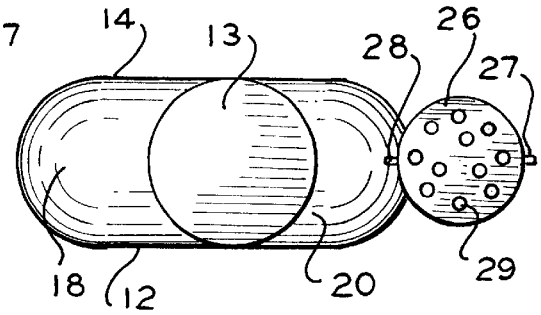
FIG. 4 is a top view of the container.
Figure 5:
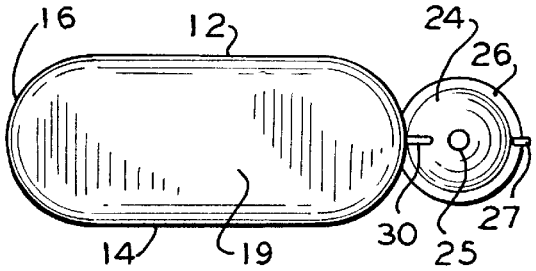
FIG. 5 is a bottom view of the container.
Figure 2:
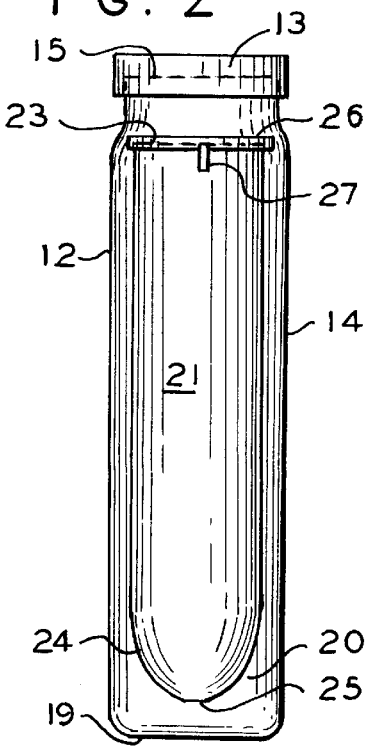
FIG. 2 is a right side view of the container.
Figure 3:
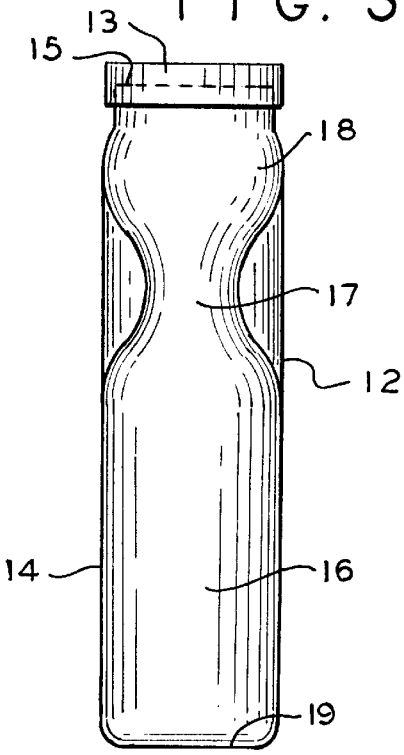
FIG. 3 is a left side view of the container.

Referring now to the drawings, the container 10 includes a bottle for holding a liquid, and a tube 21 for holding a dropper (not shown). Bottle 11 includes a top opening 15 (shown in phantom), a cap 13 covering the top opening, a front panel 12, a rear panel 14, a bottom panel 19, a first side panel 16, and a second side panel 20. The first side panel 16 has an indentation 17 to form a recess 18 adjacent the top opening 15.

Tube 21 includes a top opening 23 (shown in phantom), a cylindrical body portion 22, and a conical bottom portion 24. Covering top opening 23 is cap 26, which is attached to cylindrical body portion 22 by hinge 27. Cap 26 includes a plurality of openings 29, and the conical bottom portion 24 includes an opening 25. Openings 29 and opening 25 allow for the passage of air through tube 21 in order to dry any liquid inside tube 21 or inside a dropper (not shown) which may be contained in tube 21.

Tube 21 is fused to or made an integral part of side panel 20 of bottle 11 along the majority of the length of the cylindrical body portion 22. In order to provide further support for tube 21 so as to prevent tube 21 from being detached from bottle 11, the container 10 also includes a top support 28 which extends from side panel 20 of bottle 11 to the top of the cylindrical body portion 22 of tube 21, and a bottom support 30 extending from side panel 20 of bottle 11 to conical bottom portion 24.

The container 10 is employed in dispensing liquids, such as, for example, liquid medication, by a dropper. In order to obtain the liquid from bottle 11, one removes cap 13 from top opening 15 of bottle 11, and removes cap 26 from top opening 23 of tube 21. A dropper is removed from tube 21 and inserted into top opening 15 of bottle 11. Liquid is withdrawn from bottle 11, the dropper then is removed from bottle 11, and cap 13 is placed back over opening 15. the liquid then is dispensed from the dropper accordingly, and the dropper then is washed and/or sterilized. Once the dropper is washed and/or disinfected, it is placed back into tube 21, and cap 26 is placed over top opening 23. Air can travel through openings 29 of cap 26 and opening 25 of cylindrical bottom portion 24 in order to dry the dropper and/or the interior of tube 21 between uses of the dropper.

When only a small amount of liquid remains in bottle 11 and such liquid cannot be accessed by a dropper when the dropper is inserted vertically into bottle 11, bottle 11 may be tilted such that the liquid will travel along side panel 16, over indentation 17, and into recess 18. The dropper then is inserted through top opening 15 and into recess 18. The liquid is withdrawn from recess 18, and the dropper then is removed from bottle 11 as hereinabove described.

The present invention thus enables one to obtain small amounts of liquid from a bottle by using a dropper as well as providing a compartment for the dropper which protects the dropper from contamination and protects the liquid from contamination by an unwashed dropper. The former is accomplished by the recess 18 in the bottle formed by the indentation in the first side portion 16, and the latter is accomplished by tube 21 which is a closed container with the exception of openings 29 in cap 26 and opening 25 in conical bottom portion 24. Such openings permit the passage of air through tube 21, yet prevent contact of the dropper contained in tube 21 with insects or other animals which may carry microbes and/or viruses and prevent contact with other contaminants.

It is to be understood, however, that the scope of the present invention is not to be limited to the specific embodiments described above. The invention may be practiced other than as particularly described and still be within the scope of the accompanying claims.

What is claimed is:

1. A container, comprising:

(a) a bottle portion, said bottle portion including (i) a top opening, (ii) a cap covering said top opening, (iii) a front panel, (iv) a rear panel, (v) a bottom panel, (vi) a first side panel, said first side panel having an indentation to form a recess adjacent said top opening, and (vii) a second side panel; and (b) a tube portion, said tube portion being attached to said second side panel of said bottle portion, said tube portion including (i) a top opening, (ii) a cap covering said top opening, (iii) a cylindrical body portion, and (iv) a conical bottom portion.

2. The container of claim 1 wherein said tube portion further comprises at least one opening in said conical bottom portion.

3. The container of claim 1 wherein said tube portion further comprises at least one opening in said cap covering said top opening of said tube portion.

4. The container of claim 1 wherein said tube portion further comprises a hinge connecting said cap to said cylindrical body portion.

5. The container of claim 1, and further comprising a support means extending from said second side panel to said cylindrical body portion.

6. The container of claim 1, and further comprising a support means extending from said second side panel to said conical bottom portion.

* * * * *